US005965498A

United States Patent [19]

Smythe

[11] Patent Number: 5,965,498

[45] Date of Patent: Oct. 12, 1999

[54] TWO-CYCLE SYNTHETIC LUBRICATING OIL

[75] Inventor: John Henry Smythe, Oxford, United Kingdom

[73] Assignee: Exxon Chemical Patents Inc, Linden, N.J.

[21] Appl. No.: 09/068,924

[22] PCT Filed: Nov. 20, 1996

[86] PCT No.: PCT/EP96/05113

§ 371 Date: May 19, 1998

§ 102(e) Date: May 19, 1998

[87] PCT Pub. No.: WO97/19153

PCT Pub. Date: May 29, 1997

[30] Foreign Application Priority Data

Nov. 22, 1995 [GB] United Kingdom ..... 9523914
Apr. 24, 1996 [GB] United Kingdom ..... 9608459

[51] Int. Cl.[6] ..... C10M 111/04; C10M 169/04; C10M 159/18; C10L 1/14

[52] U.S. Cl. ..... 508/468; 508/465; 508/539; 508/577; 508/591; 44/363; 44/395; 44/459

[58] Field of Search ..... 508/468, 465, 508/539, 577, 591; 44/363, 395, 459

[56] References Cited

U.S. PATENT DOCUMENTS

| | | | |
|---|---|---|---|
| 4,664,822 | 5/1987 | Hunt et al. | 508/294 |
| 4,867,890 | 9/1989 | Colclough et al. | 508/294 |
| 4,994,196 | 2/1991 | Kugaya et al. | 508/468 |
| 5,171,461 | 12/1992 | Di Biase | 508/549 |
| 5,378,249 | 1/1995 | Morrison | 508/496 |

FOREIGN PATENT DOCUMENTS

| | | |
|---|---|---|
| 1238448 | 6/1988 | Canada . |

*Primary Examiner*—Margaret Medley

[57] ABSTRACT

A two-cycle oil composition comprising: (a) 10–20% of a first synthetic ester base stock oil (a copolymer of an alpha-olefin with an ester of a dicarboxylic acid, viscosity 20 to 50 cSt at 100° C.); (b) 18–30% of a second synthetic ester base stock oil (an oxo alcohol of a dicarboxylic acid, viscosity 3 to 10 cSt at 100° C.; (c) 30–40% of a polybutene polymer (Mn 300–1500); (d) 15–25% of a nor liquid solvent (boiling point up to 300° C., flash point of 60 °–120° C.); (e) 0.2 to 2.0% of an oil soluble copper compound, and (f) 0 to 5% of other lubricating oil additives.

13 Claims, No Drawings

TWO-CYCLE SYNTHETIC LUBRICATING OIL

This invention relates to a lubricant composition useful as a two-cycle oil. More particularly the invention relates to two-cycle synthetic oil which complies with certain test standards for land equipment, gasoline fueled, two-cycle engines, such as motorcycle engines, moped engines, snowmobile engines, lawn mower engines and the like. Two-stroke-cycle gasoline engines now range from small, less than 50 cc engines, to higher performance engines of 200 to 500 cc. The development of such high performance engines has created the need for new two-cycle oil standards and test procedures. The present composition exhibits improved detergency and smoke reduction characteristics.

Two-cycle engines are lubricated by mixing the fuel and lubricant and allowing the mixed composition to pass through the engine. Various types of two-cycle oils, compatible with fuel, have been described in the art. Typically, such oils contain a variety of additive components in order for the oil to pass industry standard tests to permit use in two-cycle engines.

Canadian Patent 1,238,448 (1988) discloses the copolymers of alpha olefins with dicarboxylic esters which are used as one component of the composition of the present invention.

U.S. Pat. No. 4,994,196 (1991) discloses two-cycle engine oils comprising the same alpha olefin dicarboxylic ester copolymers in combination with esters of pentaerythritol and calcium phenate.

U.S. Pat. No. 5,378,249 (1995) discloses biodegradable two-cycle engine oil compositions which comprise 20–80% of a heavy ester having a viscosity of at least 7 cSt at 100° in combination with 10–85 weight percent of a light ester oil having a viscosity less than 6.0 cSt at 100°.

U.S. Pat. No. 5,171,461 (1992) discloses lubricating compositions containing a combination of a sulfur compound with an oil soluble or dispersable source of copper to provide lubricating oils which exhibit improved anti-oxidant and extreme pressure properties.

U.S. Pat. No. 4,664,822 (1987) discloses metal containing lubricant compositions which contain copper overbased materials which act as a dispersant/detergent and an oxidation and corrosion inhibitor.

U.S. Pat. No. 4,867,890 discloses lubricating oil compositions containing very small proportions, that is, 5–500 parts per million of copper as an antioxidant.

The present invention is based on the discovery that the use of oil soluble copper carboxylate in synthetic ester based two-cycle oil formulations provides lubricants which exhibit improvements in smoke generation and detergency, as measured by two-cycle engine tests.

Accordingly, there has been discovered a two-cycle lubricating oil composition comprising:

a) 10–20% by weight of a first synthetic ester basestock oil being a copolymer of an alpha-olefin with an ester of a dicarboxylic acid, the oil having a viscosity of 20 to 50 cSt at 100° C.;

b) 18–30% by weight of a second synthetic ester base stock oil being an oxo alcohol ester of a dicarboxylic acid, the oil having a viscosity of 3 to 10 cSt at 100° C.;

c) 30 to 40% by weight of a polybutene polymer being a polybutene, polyisobutylene or a mixture of polybutenes and polyisobutylenes having a number average molecular weight of about 300 to 1500;

d) 15 to 25% by weight of a normally liquid solvent having a boiling point of up to 300° C.;

e) 0.2 to 2% by weight of an oil soluble copper compound; and f) 0–5% by weight of lubricating oil additives other than a polybutene.

This invention also comprises the use of the foregoing oil in a two-cycle engine.

The first synthetic ester component is known in the art and is a copolymer of an alpha olefin with a dicarboxylic acid ester. Such fluid copolymers are typically prepared from alpha olefins having 3 to 20 carbon atoms, more preferably 6 to 18 carbon atoms, such as propylene, 1-butene, 1-pentene, 1-hexene, 1-heptene, 1octene and the like. Examples of suitable dicarboxylic acids for preparing such materials include maleic acid, fumaric acid, citraconic acid, mesaconic acid and itaconic acid. The alcohol is preferably one having 1 to 20 carbon atoms, more preferably 3 to 8 carbon atoms such as methanol, ethanol, propanol, butanol, pentanol, hexanol, heptanol, octanol, nonanol, decanol, undecanol and the like. This material is prepared by copolymerizing the above described alpha olefin with the above described ester of dicarboxylic acid. Preferred is a butanol ester of an alpha olefin maleic acid polymer having an average molecular weight of about 1800 and a viscosity of 35 cSt at 100° C. wherein the ratio of olefinic to maleic acid monomers is about 1 to 1.3 which is sold commercially as "Ketjenlube 135" by Akzo Chemicals. The preferred amount of this component is in the composition of the present invention is 15%.

The second synthetic ester component is a basestock oil comprising an oxo alcohol ester of a dicarboxylic acid. Suitable oxo alcohols comprise those having about 8 to 20 carbon atoms, preferably those having about 10 to 15 carbon atoms, particularly oxo tridecyl alcohol. Such oxo alcohols are prepared by the process well known in the art which involves the catalytic reaction of olefins with carbon monoxide and hydrogen at elevated temperatures of about 300 to 400° F. and pressures of about 2500 to 4000 psig to form particularly in the presence of cobalt catalyst aldehydes having more than 1 carbon atom than the olefin feedstock, the aldehyde then being hydrogenated to the corresponding alcohol. Illustrative Examples of suitable dibasic acids which may be employed to synthesize the oxo diester fluid used in the present invention are oxalic acid, malonic acid, succinic acid, glutaric acid, adipic acid, pomelic acid, suberic acid, azelaic acid and the like, generally this being about 2 to 10 carbon atoms. Particularly preferred are adipic acid and alkyl adipic acids such as methyladipic acid and diethyladipic add. Such oxo esters synthetic base oils will have a viscosity in the range of 3 to 10 cSt at 100° C. for use in the present invention and they are preferably used in an amount of about 19 to 25%. Particularly preferred is a material sold by Exxon Chemical Company as "Vistone A-30", an oxo tridecyl alcohol adipate having a viscosity of 5.3 cSt at 100° C.

The polybutene polymer used in this invention is typically a mixture of polybutenes, a mixture of poly-nbutenes and polyisobutylene whiich normally results from the polymerization of $C_4$ olefins and will have a number average molecular weight of about 300 to 1500 with a polyisobutylene or polybutene having a number average molecular weight of about 400 to 1300 being particularly preferred, most preferable is a mixture of polybutene and polyisobutylene having a number average molecular weight of about 950. Number average molecular weight (Mn) is measured by gel permeation chromatography. Polymers composed of 100% polyisobutylene or 100% poly-n-butene are also within the scope of this invention and within the meaning of the term "a polybutene polymer".

A preferred polybutene polymer is a mixture of polybutenes and polyisobutylene prepared from a $C_4$ olefin refinery stream containing about 6 wt. % to 50 wt. % isobutylene with the balance a mixture of butene (cis- and trans-) isobutylene and less than 1 wt. % butadiene. Particularly, preferred is a polymer prepared from a $C_4$ stream composed of 6–45 wt. % isobutylene, 25–35 wt. % saturated butenes and 15–50 wt. % 1- and 2-butenes. The polymer is prepared by Lewis acid catalysis. Preferably, the oils of this invention contain about 35 wt. % polybutene.

The solvents useful in the present invention may generally be characterized as being normally liquid petroleum or synthetic hydrocarbon solvents having a boiling point not higher than about 300° C. at atmosphere pressure. The preferred amount is about 20% by weight. Such a solvent must also have a flash point in the range of about 60–120° C. such that the flash point of the two-cycle oil of this invention is greater than 70° C. Typical examples include kerosene, hydrotreated kerosene, middle distillate fuels, isoparaffinic and naphthenic aliphatic hydrocarbon solvents, dimers, and higher oligomers of propylene butene and similar olefins as well as paraffinic and aromatic hydrocarbon solvents and mixtures thereof. Such solvents may contain functional groups other than carbon and hydrogen provided such groups do not adversely affect performance of the two-cycle oil. Preferred is a naphthenic type hydrocarbon solvent having a boiling point range of about 91.1° C.–113.9° C. (196°–237° F.) sold as "Exxsol D80" by Exxon Chemical Company.

The oil soluble copper compound useful in the present invention is present in an amount of from about 0.2% to 2% by weight, with the preferred amount being 0.5% to 1.5% by weight. A wide variety of oil soluble copper compounds are useful in the compositions of this invention. By oil soluble we mean the compound is oil soluble under normal blending conditions in the oil or additive package. The copper compound may be in the cuprous or cupric form. The copper may be in the form of the copper dihydrocarbyl thio- or dithio-phosphates wherein copper may be substituted for zinc in the compounds and reactions described above although one mole of cuprous or cupric oxide may be reacted with one or two moles of the dithiophosphoric acid, respectively. Alternatively the copper may be added as the copper salt of a synthetic or natural carboxylic acid. Examples include $C_{10}$ to $C_{18}$ fatty acids such as stearic or palmitic, but unsaturated acids such as oleic or branched carboxylic acids such as napthenic acids of molecular weight from 200 to 500 or synthetic carboxylic acids are preferred because of the improved handling and solubility properties of the resulting copper carboxylates. Also useful are oil soluble copper dithiocarbamates of the general formula $(RR'NCSS)_nCu$, where n is 1 or 2 and R and R' are the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., R and R') will generally be about 5 or greater. Copper sulphonates, phenates, and acetylacetonates may also be used.

Exemplary of useful copper compounds are copper salts of alkenyl succinic acids or anhydrides. The salts themselves may be basic, neutral or acidic. They may be formed by reacting (a) any of the materials above discussed ashless dispersants which have at least one free carboxylic acid (or anhydride) group with (b) a reactive metal compound. Suitable acid (or anhydride) reactive metal compounds include those such as cuptic or cuprous hydroxides, oxides, acetates, borates, and carbonates or basic copper carbonate.

Examples of the metal salts of this invention are Cu salts of polyisobutenyl succirfic anhydride (hereinafter referred to as Cu-PIBSA), and Cu salts of polyisobutenyl succinic acid. Preferably, the selected metal employed is its divalent form e.g., $Cu^{+2}$. The preferred substrates are polyalkenyl succinic acids in which the alkenyl group has a molecular weight greater than about 700. The alkenyl group desirably has a $\overline{M}_n$ from about 900 to 1400, and up to 2500, with a $\overline{M}_n$ of about 950 being most preferred. Especially preferred is polyisobutylene succinic acid (PIBSA). These materials may desirably be dissolved in a solvent, such as a mineral oil, and heated in the presence of a water solution (or slurry) of the metal bearing material. Heating may take place between 70° and about 200° C. Temperatures of 110° to 140° C. are entirely adequate. It may be necessary, depending upon the salt produced, not to allow the reaction to remain at a temperature above about 140° C. for an extended period of time, e.g., longer than 5 hours, or decomposition of the salt may occur.

Use of copper salts in the two-cycle oils of this invention allows the oil to meet the industry requirement for exhaust smoke reduction and detergency without using the conventional relatively higher amounts of metal detergents, e.g., phenate and polybutene. Such salts are typically used in the form of concentrated oil solutions, such as solution containing about 40% by weight copper salt in oil. Particularly preferred for use in the oils of this invention are copper oleate, copper linoleate and copper naphthenate and other copper salts of $C_{10}$–$C_{18}$ fatty acids or naphthenic acids of $\overline{M}_w$ 200–500.

The invention further comprises the presence of up to 5% by weight of one or more special purpose conventional lubricating oil additives, and these may be any additive normally included in lubricating oils for a particular purpose.

Additional conventional additives for lubricating oils which may be present in the composition of this invention include viscosity modifiers, corrosion inhibitors, oxidation inhibitors, friction modifiers, dispersants, antifoaming agents, antiwear agents, pour point depressants, detergents, rust inhibitors and the like.

Typical oil soluble viscosity modifying polymers will generally have weight average molecular weights of from about 10,000 to 1,000,000 as determined by gel permeation chromatography.

Corrosion inhibitors are illustrated by phosphosulfurized hydrocarbons and the products obtained by reacting a phosphosulfurized -hydrocarbon with an alkaline earth metal oxide or hydroxide. "Cobratech 356", which is benzotrizole in propylene glycol, is preferred for use in this invention in an amount of about 0.03 wt. %.

Oxidation inhibitors are antioxidants exemplified by alkaline earth metal salts of alkylphenol thioesters having preferably $C_5$–$C_{12}$ alkyl side chain such as calcium nonylphenol sulfide, barium t-octylphenol sulfide, dioctylphenylamine as well as sulfurized or phospho sulfurized hydrocarbons.

Friction modifiers include fatty acid esters and amides, glycerol esters of dimerized fatty acids and succinate esters or metal salts thereof.

Dispersants are well known in the lubricating oil field and include high molecular weight alkyl succinimides being the reaction products of oil soluble polyisobutylene succinic anhydride with ethylene amines such as tetraethylene pentamine and borated salts thereof. Preferred for use in this invention is 2.41% of a dispersant comprising a borated Mn 950 polyisobutenyl succinimide.

Pour point depressants also known as lube oil flow improvers can lower the temperature at which the fluid will flow and typical of these additives are $C_8$–$C_{18}$ dialkyl fumarate vinyl acetate copolymers, polymethacrylates and wax naphthalene.

Foam control can also be provided by an anti-foamant of the polysiloxane type such as silicone oil and polydimethyl siloxane.

Anti-wear agents reduce wear of metal parts and representative materials are zinc dialkyldithiophosphate and zinc diaryl diphosphate.

Detergents and metal rust inhibitors include the metal salts of sulfonic acids, alkyfphenols, sulfurized alkylphenols, alkyl salicylates, naphthenates and other oil soluble mono and dicarboxylic acid. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur. Preferred for use in this invention is 1.5% by weight nonylphenol sulfide.

Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms. Preferred for use in the invention is 0.58% by weight calcium phenate.

The lubricating oil compositions of the present invention will mix freely with the fuels used in such two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline is defined by ASTM specification D-439-73. Such fuels can also contain non-hydrocarbonaceous materials such as alcohols, ethers, organo nitro compounds and the like, e.g., methanol, ethanol, diethyl ether, methylethyl ether, nitro methane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitro methane, etc. Particularly preferred is gasoline, that is, a mixture of hydrocarbons having an ASTM boiling point of 60° C. at the 10% distillation point to about 205° C. at the 90% distillation point.

The lubricants of this invention are used in admixture with fuels in amounts of about 20 to 250 parts by weight of fuel per 1 part by weight of lubricating oil, more typically about 30–100 parts by weight of fuel per 1 part by weight of oil. Such admixtures and their use in two-cycle engines are further embodiments of this invention.

The invention is further illustrated by the following examples which are not to be considered as limitative of its scope. Examples 2 and 3 are for comparison and are not part of this invention. All percentages are by weight.

EXAMPLE 1 (EEC 16275A)

Two oils of the invention were prepared from the following: (Trademarked components (a), (b), (c) and (i) are identified in the specification):

| Component | Oil 1-A | Oil 1-B |
|---|---|---|
| (a) "Ketjenlube 135" | 15.00% | 15.00% |
| (b) "Vistone A-30" | 24.25% | 19.78% |
| (c) "Exxsol D-80" | 20.00% | 25.00% |
| (d) Polyisobutylene Mn 950 | 35.00% | 35.00% |
| (e) Copper Oleate (active ingredient) | 1.23% | 0.70% |
| (f) Borated Mn 950 polyisobutenyl succinimide dispersant | 2.41% | 2.41% |
| (g) Calcium Phenate | 0.58% | 0.58% |
| (h) Nonylphenol sulfide | 1.50% | 1.50% |
| (i) "Cobratech 35G" | 0.03% | 0.03% |
| | 100% | 100% |

These two oils were evaluated in accordance with the JASO M345 test procedures JASO M340, M341, M342 and M343. This is an engine test established by society of Automotive Engineers of Japan (JSAE) for two-cycle gasoline engine oils. As of Jul. 1, 1994, oils used in two-cycle engines are being labeled in accordance with the JASO-M345 standards as announced by the Japan Automobile Standards Organization (JASO). JASO published the JASO M345 standards in Apr., 1994. "EGD Detergency" is a reference to a further modification of the normal JASO M341 detergency test (1 hour) procedure in which the test is run for 3 hours. This is a more stringent standard expected to be adopted by ISO (the International Organization for Standardization) as published by Committee Draft of Jan. 5, 1995 of the Technical Committee 28. "FC" is the highest performance standard for the JASO M345 standards.

The engine test results for Oils 1-A and 1-B are in the Table below.

| | JASO M345 | | | |
|---|---|---|---|---|
| Oil | 1-A | 1-B | Standard -FC Minimum | ISO-EGD Minimum |
| EGD Detergency | 151/155 | 126/135 | — | 125 |
| JASO Detergency M341 | 123 | 118 | 95 | — |
| JASO Smoke M342 | 182 | 163 | 85 | 85 |

EXAMPLE 2 (COMPARATIVE EXAMPLE)

An oil being the same as Example 1 was formulated except it contained 25.48% of the Vistone A-30 and no copper oleate.

This oil had a value of 137 in the JASO Smoke M342 test, which is significantly less than Oils 1-A and 1-B of this invention.

EXAMPLE 3 (COMPARATIVE EXAMPLE)

Another oil was formulated being the same as Example 1 except that it had 24.81% of Vistone A-30, 0.25 wt. % of a calcium sulfonate and no copper oleate.

This oil had a value of 121 in the EDG Detergency test which is not a passing value.

EXAMPLE 4

Another oil similar to Oil 1-A was prepared which contained 19.25 of Vistone A-30 and 25% of Exxsol D-50, but otherwise the same.

This oil had a value of 159 in the EDG Detergency test and 183 in the JASO Smoke M342 test.

Examples 2 and 3 which contained no copper salt, showed inferior characteristics in terms of both smoke generation and detergency when measured in two-cycle engines.

What is claimed is:

1. A two-cycle oil composition comprising:

(a) 10–20% of a first synthetic ester base stock oil being a copolymer of an alpha-olefin with an ester of a dicarboxylic acid, the oil having a viscosity of 20 to 50 cSt at 100° C., (b) 18–30% of a second synthetic ester base stock oil being an oxo alcohol ester-of a dicarboxylic acid, the oil having a viscosity of 3 to 10 cSt at 100° C., (c) 30 to 40% of a polybutene polymer being a polybutene, polyisobutylene or mixture of polybutenes and polyisobutylenes having an Mn of 300–1500, (d) 15 to 25% of a normally liquid solvent having a boiling point up to 300° C. and a flash point of 60°–120° C., (e) 0.2 to 2.0% of an oil soluble copper compound, and (f) 0 to 5% of other lubricating oil additives.

2. The composition of claim 1 wherein said (a) amount is 15%, said (b) amount is 25%, said (c) amount is 35%, said (d) amount is 20% and said (e) amount is 0.5 to 1.5%.

3. The composition of claim 1 or 2 wherein said ester of the dicarboxylic acid is butanol ester and said copolymer (a) has a viscosity of 35 cSt at 100° C. and a Mw of about 1800.

4. The composition of claims 1 or 2 wherein (b) is oxo tridecyl adipate having a viscosity of about 5.3 cSt at 100° C.

5. The composition of claims 1 or 2 wherein (c) polybutene has an Mn of 950.

6. The composition of claims 1 or 2 wherein (d) is a naphthenic solvent having a boiling point range of 91.1° C.–113.9° C.

7. The composition of claims 1 or 2 wherein (e) is copper oleate.

8. A fuel lubricant mixture for two-cycle engines which exhibits improved detergency and reduced smoke emissions upon combustion which comprises 20 to 250 parts by weight, fuel per 1 part by weight of the oil of claims 1 or 2.

9. The mixture of claim 8 wherein the range is 30–100 parts of fuel per part of oil.

10. A composition of claim 1 wherein said ester of the dicarboxlic acid is butanol ester and said copolymer (a) has a viscosity of 35 cSt at 100° C. and a Mw of about 1800, (b) is oxo tridecyl adipate having a viscosity of about 5.3 cSt at 100°, (c) the polybutene has a Mw of 950, (d) is a naphthenic solvent having a boiling point range of 91.1° C.–113.9° C., and (e) is copper oleate.

11. A method for improving detergency and reducing smoke combustion upon combustion of a two-cycle engine fuel, the method comprising adding to the two-cycle engine fuel an oil composition of claim 1.

12. A method according to claim 11 wherein said ester of the dicarboxylic acid is butanol ester and said copolymer (a) has a viscosity of 35 cSt at 100° C. and a Mw of about 1800, (b) is oxo tridecyl adipate having a viscosity of about 5.3 cSt at 100°, (c) the polybutene has a Mw of 950, (d) is a naphthenic solvent having a boiling point range of 91.1° C.–113.9° C., and (e) is copper oleate.

13. A method for improving detergency and reducing smoke combustion upon combustion of a two-cycle engine fuel, the method comprising adding to the two-cycle engine fuel 1 part by weight of an oil composition of claim 1 per 20 to 250 parts by weight of the two-cycle engine fuel.

* * * * *